US012624506B2

(12) United States Patent
Braun et al.

(10) Patent No.: US 12,624,506 B2
(45) Date of Patent: May 12, 2026

(54) ASPHALT DISTRIBUTOR WITH MULTISPEED MOTOR

(71) Applicant: E.D. Etnyre & Co., Oregon, IL (US)

(72) Inventors: Tyler Braun, Rockford, IL (US); Nick Frohmader, Rockford, IL (US)

(73) Assignee: E.D. Etnyre & Co., Oregon, IL (US)

( * ) Notice: Subject to any disclaimer, the term of this patent is extended or adjusted under 35 U.S.C. 154(b) by 825 days.

(21) Appl. No.: 17/893,847

(22) Filed: Aug. 23, 2022

(65) Prior Publication Data

US 2024/0068176 A1 Feb. 29, 2024

(51) Int. Cl.

| | |
|---|---|
| ***E01C 19/17*** | (2006.01) |
| ***F04B 17/05*** | (2006.01) |
| ***F04B 49/20*** | (2006.01) |

(52) U.S. Cl.

CPC ..... *E01C 19/174* (2013.01); *F04B 17/05* (2013.01); *F04B 49/20* (2013.01); *F04B 2203/0605* (2013.01)

(58) Field of Classification Search

CPC .. F04B 17/05; F04B 49/20; F04B 2203/0605; E01C 19/174

See application file for complete search history.

(56) References Cited

U.S. PATENT DOCUMENTS 3,239,148 A * 3/1966 Etnyre ..... E01C 19/174 239/159
3,356,261 A * 12/1967 Stein ..... E01C 19/202 222/63
3,529,772 A * 9/1970 Brodersen ..... B05B 9/06 239/157
3,674,177 A * 7/1972 Hawkins ..... B05B 9/06 222/52
4,768,143 A * 8/1988 Lane ..... G05B 13/044 700/42
4,817,870 A * 4/1989 Dalton ..... B60P 3/30 239/168
5,944,049 A * 8/1999 Beyer ..... F04D 27/0269 137/907
5,957,621 A * 9/1999 Clark, Jr. ..... E01C 19/174 404/101

(Continued)

FOREIGN PATENT DOCUMENTS

CN 104594162 B * 8/2016 ..... E01C 19/17
CN 106480808 3/2017

OTHER PUBLICATIONS

Wikipedia, Proportional integral derivative controller, 2021.*
Machine Translation of 104594162.*

*Primary Examiner* — Christopher S Bobish
(74) *Attorney, Agent, or Firm* — Hinshaw & Culbertson LLP; Roger M. Masson, Esq.

(57) ABSTRACT

An asphalt distributor has a multispeed hydraulic motor mechanically driving an asphalt pump. The asphalt distributor has a controller for controlling the flow rate of asphalt being sprayed. The controller has a gain for controlling the flow rate. During a transition when the speed of the multispeed hydraulic motor changes, the gain has a value for the transition. Beneficially, the asphalt distributor has a wider than conventional asphalt spraying flowrate over which it provides a consistent spray. A method for controlling the flowrate involves adjusting, preferably dynamically, the value of the gain during the transition.

20 Claims, 3 Drawing Sheets

(56) References Cited

U.S. PATENT DOCUMENTS

| | | | | |
|---|---|---|---|---|
| 6,712,906 | B2 * | 3/2004 | Estelle | B05B 12/085 156/578 |
| 7,603,185 | B2 * | 10/2009 | Stewart | G05B 13/042 700/32 |
| 7,802,737 | B2 | 9/2010 | Rayner | |
| 8,191,792 | B2 * | 6/2012 | Bandoh | G01K 1/143 236/1 C |
| 8,360,738 | B2 * | 1/2013 | Van Den Wyngaert | F04B 49/065 417/307 |
| 8,427,126 | B2 * | 4/2013 | Peng | H02M 3/157 323/283 |
| 9,052,705 | B2 * | 6/2015 | Gao | G05B 19/416 |
| 9,141,114 | B2 * | 9/2015 | Slupphaug | G05D 7/0635 |
| 9,712,098 | B2 * | 7/2017 | Kidd | H02H 7/0822 |
| 9,720,387 | B2 * | 8/2017 | Gao | G05B 19/416 |
| 9,977,433 | B1 * | 5/2018 | Teuscher | E04H 4/1654 |
| 10,415,569 | B2 * | 9/2019 | Stiles, Jr. | F04B 49/20 |
| 10,590,926 | B2 * | 3/2020 | Kidd | F04D 15/0077 |
| 11,186,747 | B2 * | 11/2021 | Humphreys | B01F 23/47 |
| 11,290,049 | B2 * | 3/2022 | Luh | F04B 49/20 |
| 11,376,350 | B2 * | 7/2022 | Gaspredes | F04B 49/08 |
| 2008/0082242 | A1 * | 4/2008 | Dell'Eva | F16H 61/0251 477/34 |
| 2016/0146202 | A1 * | 5/2016 | Zhang | F04B 49/065 700/282 |
| 2019/0234398 | A1 * | 8/2019 | Endo | F04B 49/20 |
| 2020/0343841 | A1 * | 10/2020 | Rotilli Filho | H02P 6/183 |
| 2022/0056649 | A1 | 2/2022 | Olsen et al. | |
| 2023/0250989 | A1 * | 8/2023 | Wang | G05B 13/042 700/276 |
| 2024/0052827 | A1 * | 2/2024 | Zhu | F04B 49/03 |
| 2024/0345545 | A1 * | 10/2024 | Saini | H02P 23/0004 |

* cited by examiner

ASPHALT DISTRIBUTOR WITH MULTISPEED MOTOR

FIELD OF THE INVENTION

The invention relates to asphalt distributors.

BACKGROUND

Asphalt distributors are used in building and maintaining roadways, particularly using the chip and seal technique. In the chip and seal technique, asphalt is first sprayed often onto existing paving by an asphalt distributor. The sprayed asphalt is then covered with "chips," typically aggregate. The asphalt binds the chips so they stay in place. Asphalt distributors have a number of discrete sprays arranged typically substantially linearly so that asphalt can be sprayed across a width of the roadway that is often wider than the asphalt distributor. An exemplary asphalt distributor is described in U.S. Pat. No. 4,817,870.

Problems arise if too little or too much asphalt is applied. If too little is applied, the chips won't stay in place. If too much is applied, the asphalt will puddle on the surface of the roadway and the asphalt will spread onto vehicles driving on the roadway. Uneven applications of asphalt will contribute to inconsistent road surfaces, creating bumps and ridges. Therefore it is important to maintain an even application rate (e.g., volume per area) over the entire area being coated in asphalt.

Conventional asphalt distributors are designed to have an even application rate and can achieve this for relatively straight roadways. Conventional asphalt distributors have trouble maintaining the application rate when the width of spray is much less than the width of the asphalt distributor, i.e., few sprays are being used, and the asphalt spraying flowrate becomes small. Commonly, this occurs when applying asphalt is sprayed in turnarounds, intersections and shoulders. Alternatively, because of the difficulty in maintaining accurately a low flow rate, a higher flowrate may be used by deliberate overspraying, i.e., spraying where asphalt is not needed. A need therefore exists for an asphalt distributor that can maintain an even application rate across a wide range of flowrates or in all applications that an asphalt distributor is likely to be used.

Asphalt distributors having an even application rate across a wide flowrate range have been attempted. Theoretically, an asphalt distributor having a two-speed hydraulic motor driving the asphalt pump could provide a wide flowrate range. However, in practice when the speed on the hydraulic motor changes, the spray fluctuates visibly. The fluctuation may cause the spray from the sprayers to not overlap properly or for the spray to surge. Either type of fluctuation could cause roadway inspectors to give the paving a failing grade. A need therefore exists for an asphalt distributor having a two-or-more-speed motor that can change hydraulic motor speed while maintaining an even application rate.

Historically, asphalt distributors have had manual transmissions with a clutch. As the number of drivers proficient in shifting gears with a clutch declines, the popularity of asphalt distributors with automatic transmissions increases. However, in addition to the increased cost of an automatic transmission versus a manual transmission, there is an additional cost of a drop box for an automatic transmission to drive the hydraulic system because manual transmissions are capable of operating at a higher rpm without making the distributor go faster. The added drop box adds $8,000 to $10,000 to the cost of an asphalt distributor. A need therefore exists for an asphalt distributor having an automatic transmission that is not so costly.

SUMMARY OF THE INVENTION

In one embodiment of the invention, an asphalt distributor for spraying asphalt onto the ground is provided. The ground is typically a prepared pavement. The asphalt distributor has a multispeed hydraulic motor having a first speed and a second speed. The multispeed hydraulic motor may have additional speeds, but two speeds are preferred. The asphalt distributor also has an asphalt pump mechanically driven by the multispeed hydraulic motor. There may be a gear box (typically non-adjustable) to change the rate of rotation between the asphalt pump and the multispeed hydraulic motor. The asphalt distributor has a controller for controlling the flow rate of asphalt being sprayed. The controller has a gain for controlling the flow rate. The gain has a value for the first speed, a value for the second speed, and a value for a transition for a change in speed between the first and second speeds. The value for the transition is different from the value for the first speed and the value for the second speed. The gain may have more than one value during the transition in which case at least one of these values is different from the value for the first speed and the value for the second speed.

The asphalt distributor may also have one or more axles for supporting the vehicle on the ground, a vessel for holding the material to be spread on or into the ground, a plurality of valves for controlling the lateral extent of distribution of the material on or into the ground; a control panel for controlling valves, and a plurality of spray nozzles. Each of the valves are typically in fluid communication with one or more of the spray nozzles. The spray nozzles are typically arranged laterally to distribute material across the maximum lateral extent of distribution when all of the valves are open. The asphalt distributor may have a heater for the vessel. The pump is operable to pump liquid from the vessel through the open control valves and out the corresponding nozzles.

The asphalt distributor may have an engine and a hydraulic pump driven by the engine. The controller changes the flow rate of hydraulic fluid pumped by the hydraulic pump for achieving the desired asphalt flow rate. The engine is typically an internal combustion engine, gasoline or diesel, but could be electric.

The transition may have a predetermined duration. The predetermined duration is expected to be 1 second or less, preferably less than 750 ms, preferably less than 250 ms for the transition from a higher speed to a lower speed. Alternatively, the transition ends when the relative error is below about 10%, and more preferably below about 5%.

There may be two transitions, one from first to second speed and one from second to first speed. The value for a transition for a change in speed between the first and second speeds is the transition for a change in speed from the first speed to the second speed. The gain for controlling the flow rate may have a value for a transition for a change in speed from the second speed to the first speed. This value may also be different than the value for first speed and the value for second speed.

The gain can be a proportional gain, an integral gain or a derivative gain. The controller can have two gains, typically, a proportional gain and an integral gain.

The value of the gain during the transition may be dynamically adjusted, preferably by the controller, i.e., the controller has a dynamic adjustment capability or feature for dynamic adjustment of the gain during the transition. The dynamic adjustment of the gain may include an increase in the proportional gain of the controller. Preferably, the increase in the proportional gain is a function of the relative error. Preferably, the increase increases as the relative error increases. The dynamic adjustment of the gains may include a decrease in an integral gain of the controller. Preferably, the decrease in the integral gain is a function of the relative error. Preferably, the decrease increases as the relative error decreases.

The value of the gain may be static during the transition. In particular, the integral gain may be set to zero, particularly for transitions from a higher speed to a lower speed.

In another embodiment of the invention, a method of controlling the flowrate of an asphalt pump driven by a multispeed hydraulic motor during a transition for a speed change of the motor is provided. The method includes adjusting a gain of a controller controlling the flowrate during the transition. Preferably, the asphalt pump is mechanically driven by the multispeed hydraulic motor. Preferably, the adjustment is dynamic.

Preferably the adjustment includes increasing a proportional gain of the controller relative to the proportional gain for the speed that the speed is being changed to.

Preferably adjusting the gain include decreasing an integral gain of the controller relative to the integral gain for the speed that the speed is being changed to.

Preferably, the method also includes measuring the flowrate of the asphalt pump and calculating the relative error of the flowrate based on the measured flowrate.

Preferably, adjusting a gain includes dynamically adjusting a proportional gain of the controller as a function of the relative error. Preferably, the function is linear.

Preferably, adjusting a gain comprises dynamically adjusting an integral gain of the controller as a function of the relative error. Preferably, the function is linear.

Preferably, adjusting the gain includes adjusting the value of the gain relative to the value of the gain for the speed to which the speed is being changed. Preferably, the method includes terminating the transition after a predetermined duration followed by controlling the flowrate of the asphalt pump using the value of the gain for the speed to which the speed was changed.

DETAILED DESCRIPTION OF THE INVENTION

Figure 1:
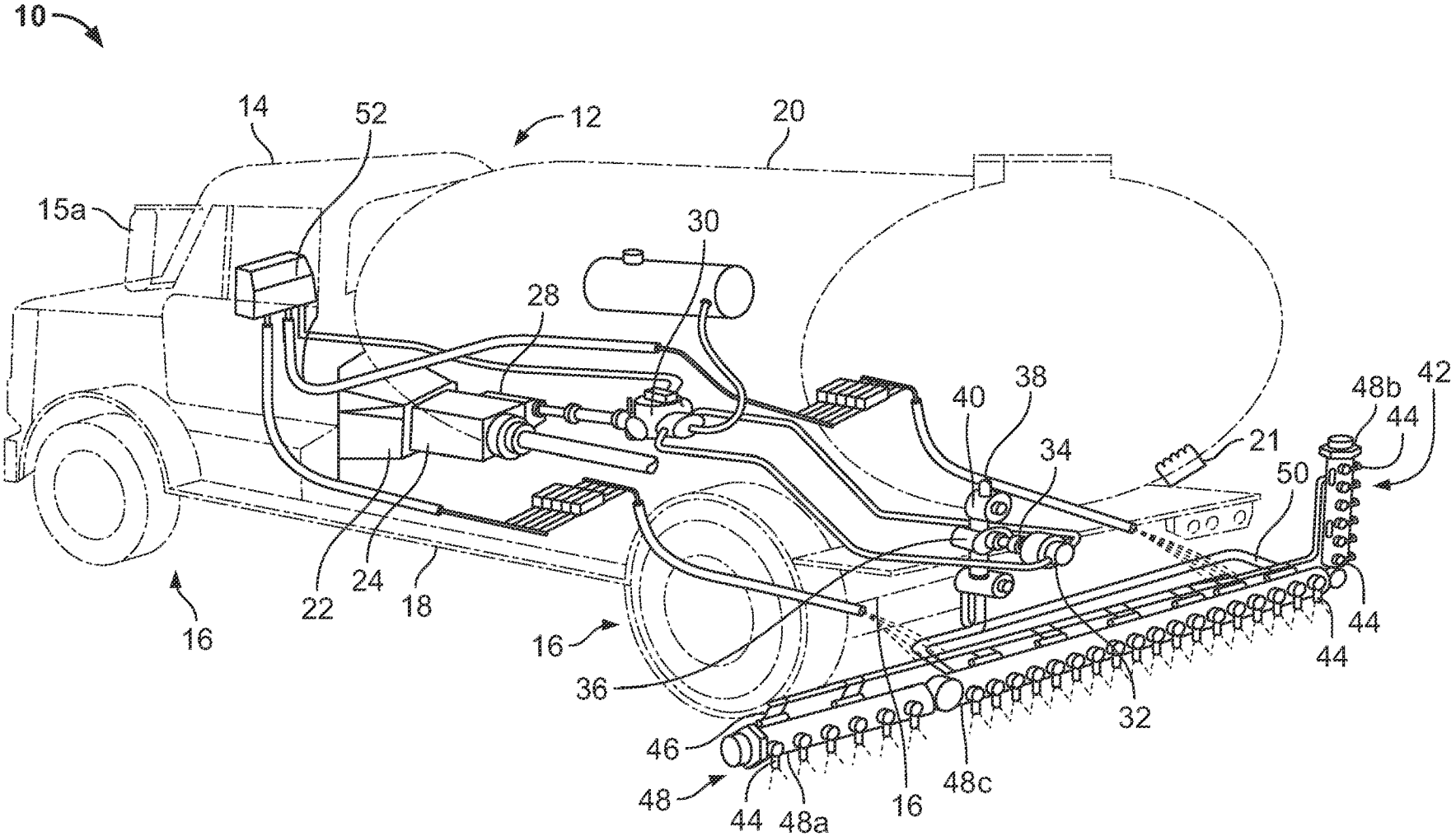
FIG. 1 is a perspective view of an asphalt distributor.

In an embodiment of the invention, an asphalt distributor 10 is provided. Fluid distributor 10 includes a motorized vehicle 12 (shown in phantom), typically a truck, having a cab 14, one or more side view mirrors 15, two or more axles 16, a chassis 18, and a tank or vessel 20 mounted to chassis 18. Tank 20 is used to store the asphalt to be distributed, i.e., sprayed. Tank 20 may be heated by a heater 21 of any suitable kind. Heater 21 is shown schematically as an electric heater.

Fluid distributor 10 has an engine 22 (shown schematically), which drives a transmission 24 (shown schematically) and a power take off 28. Engine 22 may be any suitable engine such as an internal combustion engine, diesel or gasoline, or an electric motor. Transmission 24 may be any suitable transmission for driving one or more axles 16, such as a manual transmission or an automatic transmission. Transmission 24 is connected to a power takeoff 28. Engine 22 drives transmission 24 which drives power take off 28, which in turn drives a hydrostatic transmission 29. Alternatively, engine 22 can drive hydrostatic transmission 29 via a front crank shaft for a manual or automatic transmission.

Hydrostatic transmission 29 includes a hydraulic drive pump 30, a multi-speed hydraulic motor 32, and an optional gear box 34. Hydraulic drive pump 30 pumps hydraulic fluid which causes hydraulic motor 32 to rotate thereby driving gear box 34. Hydraulic drive pump 30 is an axial piston motor having a continuously adjustable swashplate. Gear box 34 is used to convert the rate of rotation from $\omega_2$ to $\omega_3$. Typically gear box 34 is fixed such that the ratio of $\omega_2$ to $\omega_3$ is fixed. Hydraulic motor 32 may be any suitable multi-speed motor including an axial piston motor having an adjustable swashplate, such as the Bosch Rexroth A10. Hydraulic motor typically has 2 speeds, but can have more speeds.

Hydrostatic transmission 29 is connected to and drives asphalt pump 36, typically via gear box 34. Pump 36 may be of any suitable type. Preferably, it is of constant displacement, metering type such as a gear pump. Pump 36 draws fluid from tank 20 via an intake port 38 having an intake valve 40.

Asphalt pump 36 pumps asphalt from tank 20 to an asphalt distribution system 42 located at the rear end of vehicle 12. Working from the end backwards, asphalt distribution system 42 has spray nozzles 44 (or outlets) for spraying the asphalt, control valves 46, spray bar 48, and conduit/piping system means 50. Spray nozzles 44 are arranged on spray bar 48, typically uniformly spaced along spray bar 48. Spray bar 48 may be extendable or fixed. Fixed spray bars have a length that typically is approximately the same as or narrower than vehicle 12. Extendable spray bars of any suitable design are designed to extend beyond the width of vehicle 12 in operation, but to retract to be at or less than the width of vehicle 12 for ease of transportation. As shown, spray bar 48 is extendable having pivotal end portions 48*a* and 48*b* and a central portion 48*c*. Pivotal end portions are sometimes called spray bar wings. Alternatively, spray bar 48 could be a variable width spray bar having central portion 48*c* and end portions that move in and out in several positions. End portion 48*a* is shown in the extended position with spraying occurring in FIG. 1 while end portion 48*b* is shown in the retracted position with no spraying occurring. Central portion 48*c* is shown spraying. Spray bar 48 may be located at the front end or the rear of vehicle 12. Flow of asphalt to spray nozzles 44 is controlled by control valves 46. In one embodiment, there are three spray nozzles 44 per foot of spray bar 48 and one control valve 46 per spray nozzle 44. Other arrangements are also contemplated, such as one valve 46 controlling the flow through three spray nozzles 44. Fluid distribution system 42 has the necessary conduit, whether tubing, hoses, piping or mixtures thereof for connecting distribution system 42 together.

Figure 2:
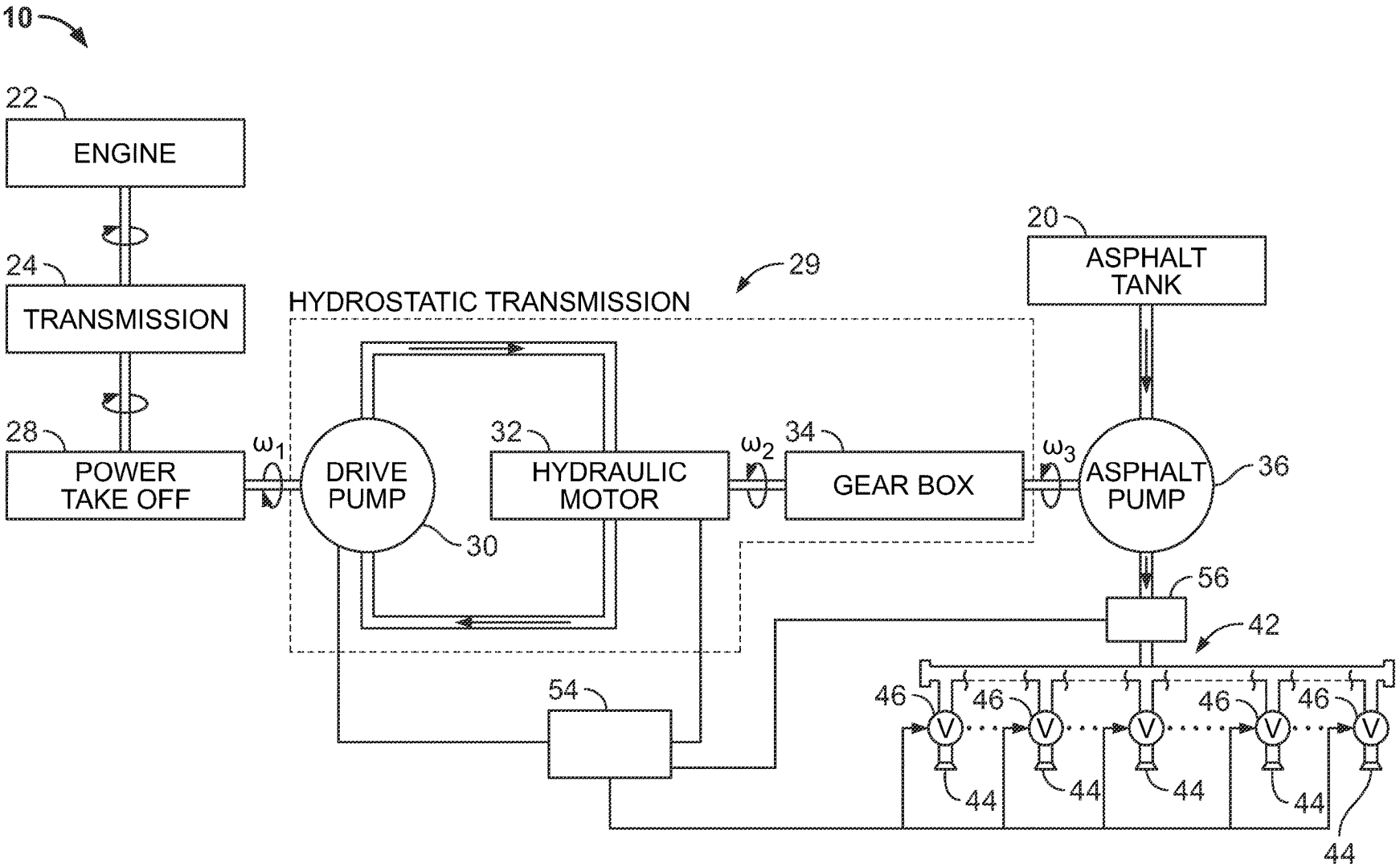
FIG. 2 is a schematic view of the distributing apparatus of the asphalt distributor of FIG. 1.

Asphalt distributor 10 has a control panel 52 for controlling the distribution of asphalt. Control panel 52 is typically located in cab 14 so that the operator of asphalt distributor 10 can drive vehicle 12 while controlling the distribution of asphalt via control valves 46. Asphalt distributor 10 has a controller 54 for controlling the flowrate of asphalt. Controller 54 measures the flowrate from pump 36 by a flowmeter 56 based on any suitable method. The flowmeter need not be located at the location shown in FIG. 2. Preferably, flowmeter 56 measures the flowrate using a proximity sensor in asphalt gear pump 36 to count teeth in asphalt gear pump 36 passing by the proximity sensor as the axle of hydraulic motor rotates or indirectly by measuring $\omega_3$ or $\omega_2$ using an encoder disk with an optical sensor. Controller 54 controls the flowrate of asphalt pump 36 by adjusting the flowrate of drive pump 30, typically by adjusting the angle of its swashplate. Any suitable controller may be used including a P, PI or a PID controller, which may be computer-based. If a P, PI, or PID controller is used, its gain(s) may be tuned by any suitable method such as the Ziegler-Nichols methods. $K_P$, $K_I$, and $K_D$ denote the proportional, integral and derivative gains. It may not be necessary for all the gains to be non-zero. Controller 54 may also control the opening and closing of valves 46 and calculate the desired flowrate based on the number of valves open and the desired application rate.

In addition to having gains, controller 54 has programming to provide an even flowrate when the speed of motor 32 changes. When motor 32 is a two-speed motor, the programming preferably implements algorithm 70 shown in FIG. 3. For purposes of explaining algorithm 70, motor 32 will be assumed to be in its high speed and the discussion will start at step 72. At step 72, controller 54 (which is assumed to be a PID or a digital equivalent of a PID controller) is in the high flowrate mode, which means that it is using gain(s) tuned to achieve proper control for high flowrates, e.g., $K_{P,high}$, $K_{I,high}$, and $K_{D,\ high}$. In high flowrate mode, controller 54 calculates the error, which is the difference between the desired flowrate (or flowrate setpoint) and the measured flowrate. The error and the gains are then used to adjust the flowrate of hydraulic fluid produced by drive pump 30 as is conventional for a PID controller.

At step 74, controller 54 checks the flowrate and compares it to the change point for changing to the low flowrate mode. If the flowrate is above the low change point, the algorithm returns to step 72. If not, controller 54 causes the speed of motor 32 to change to low in step 76 (or to initiate the change to low speed) thereby initiating a transition to low speed. Essentially simultaneously to step 76, e.g., immediately before or after, optionally in step 78, controller 54 starts a timer at 0. In step 80, controller 54 calculates the absolute relative error denoted as $E_{rel}$ in equation 1 below.

$$E_{rel}=|q_{SP}-q|/q_{SP} \quad \text{(eq. 1)}$$

where $q_{SP}$ is the desired flowrate or setpoint and q is the measured or calculated flowrate.

In step 82, scaling factors $SF_P$ and $SF_I$ are calculated for gains $K_P$ and $K_I$ of controller 54 based on equations 2 and 3 below.

$$SF_P=(S_{max,P}-S_{min,P})*E_{rel}+S_{min,P} \quad \text{(eq. 2)}$$

$$SF_I=(S_{max,I}-S_{min,I})*E_{rel}+S_{min,I} \quad \text{(eq 3)}$$

where $S_{max}$ represents the most that the scale factor SF can be assuming a maximum error of 100%; $S_{min}$ represents the minimum that the scale factor SF can be, i.e, the scale factor when the absolute relative error is 0. The value of the scale factor maximums and minimums are based in part on the inventors' insight into the process including that the integral gain should generally be reduced as the integral term has less relevance when the speed of hydraulic motor 32 changes, especially initially.

In step 84, new gains are calculated based on the scale factors as set forth in equations 4 and 5 below.

$$K_{Pscaled}=SF_P*K_{P,low} \quad \text{(eq. 4)}$$

$$K_{Iscaled}=SF_I*K_{I,low} \quad \text{(eq. 5)}$$

$K_{P,low}$ and $K_{I,low}$ represents the normal gains in low flowrate mode (step 90), i.e., outside any transition. Of course, steps 80, 82 and 84 can be combined in a single step or two steps. As can be seen, the gains are dynamically adjusted by a linear function of the relative error in step 84.

The new gains, $K_{Pscaled}$ and $K_{Iscaled}$, are then used by controller 54 instead of $K_{P,low}$ and $K_{I,low}$ in step 86 to correct the flowrate in the ordinary manner. It is contemplated that if derivative control is used that its gain could be zero or minimized during the transition in a way similar to the integral gain or increased.

In step 88, controller 54 checks to see if the criterion or criteria for ending the transition period has occurred. One criterion can be whether the timer (or elapsed time of the transition period) has reached a target to account for the time that it takes the motor to change speed. Another criterion can be whether the error is below a certain threshold, for example 10%, or more preferably 5%. Other suitable criteria are possible. The criteria may be used in combination in various ways, e.g, two criteria have to be met before ending the transition period or either of two criteria have to be met before ending the transition period.

If the criterion or criteria are not satisfied then the next step is step 80 and the transition period continues until the criterion or criteria are satisfied.

If the criterion or criteria are satisfied then the next step is step 90 thereby ending the transition to low flowrate mode. At step 90, controller 54 is in the low flowrate mode, which means that it is using gain(s) tuned to achieve proper control for low flowrates. In low flowrate mode, controller 54 use the error and gains $K_{P,low}$ and $K_{I,low}$ to adjust the flowrate of hydraulic fluid produced by drive pump 30 as is conventional for a PID controller.

Figure 3:
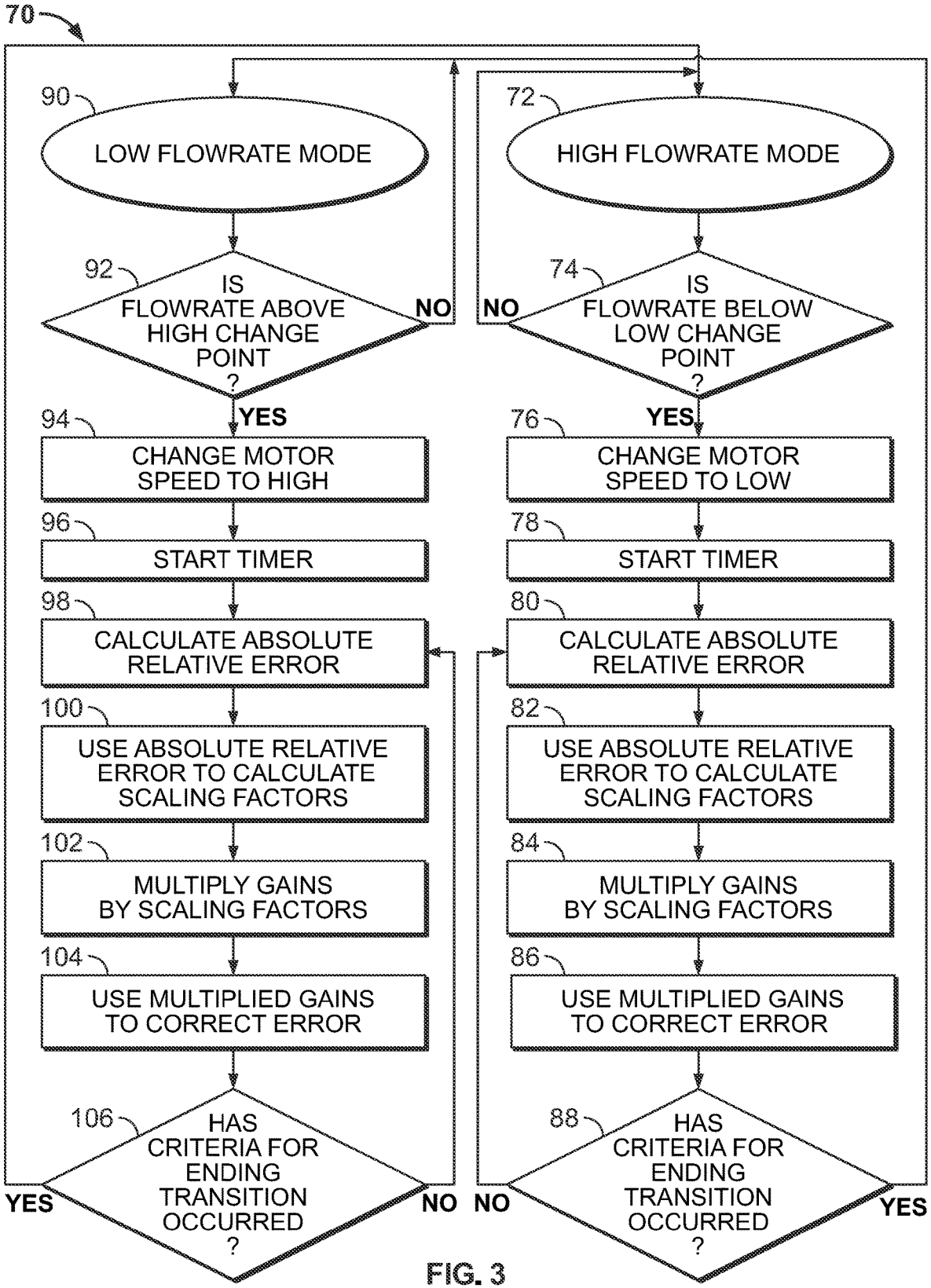
FIG. 3 is a flowchart illustrating an algorithm programmed in the controller shown in FIG. 2.

Conceivably, another criterion for ending the transition to low speed mode could be whether the flowrate setpoint is above the high change point (use of this criterion is not shown in FIG. 3). If this criterion is met, the algorithm could go to step 94.

At step 92, controller 54 checks the flowrate and compares it to the change point for changing to high flowrate mode. If the flowrate is below the high change point, the algorithm returns to step 90. The high change point is usually different and higher than the low change point to avoid a situation where the motor is having to change speed frequently. If not, controller 54 causes the speed of motor 32 to change to high in step 94 (or to initiate the change to high speed) thereby initiating a transition to high speed. Essentially simultaneously to step 94, e.g., immediately before or after, optionally in step 96, controller 54 starts a timer at 0. In step 98, controller 54 calculates the absolute relative error denoted as $E_{rel}$. In step 100, scaling factors $SF_P$ and $SF_I$ are calculated for gains $K_P$ and $K_I$ of controller 54 based on equations 2 and 3, but note that the value of constants $S_{max,P}$, $S_{min,P}$, $S_{max,I}$ and $S_{min,I}$ may be different between steps 100 and 82.

In step 102, new gains are calculated based on the scale factors as set forth in equations 6 and 7 below.

$$K_{P,scaled}=SF_P*K_{P,high} \quad \text{(eq. 6)}$$

$$K_{I,scaled}=SF_I*K_{I,high} \quad \text{(eq. 7)}$$

$K_{P,high}$ and $K_{I,high}$ represents the normal gain in high flowrate mode (step 72), i.e., outside any transition. Of course, steps 98, 100 and 102 can be combined in a single step or two steps. As can be seen the gains are dynamically adjusted by a linear function of the relative error in step 102.

The new gains, $K_{P,scaled}$ and $K_{I,scaled}$, are then used by controller 54 instead of $K_{P,high}$ and $K_{I,high}$ in step 104 to correct the flowrate in the ordinary manner. It is contemplated that if derivative control is used that its gain could be zero or minimized during the transition in a way similar to the integral gain or increased.

In step 106, controller 54 checks to see if the criterion or criteria for ending the transition period has occurred similar to step 88. If elapsed time is a criterion, the elapsed time target for step 106 can be different than the one for step 88 because the amount of time to change speed can vary depending on the speed. If the criterion or criteria are not satisfied then the next step is step 98 and the transition period continues until the criterion or criteria are satisfied.

If the criterion or criteria are satisfied then the next step is step 72, previously discussed, thereby ending the transition to high flowrate mode.

Conceivably, another criterion for ending the transition to low speed mode could be whether the flowrate setpoint is above the low change point (use of this criterion is not shown in FIG. 3). If this criterion is met, the algorithm could go to step 94.

EXAMPLE

Experimentation was performed on an asphalt distributor having a Rexroth A10 hydraulic motor. It was found that much better performance could be achieved using a multi-speed hydraulic motor versus a single speed motor over a wide range of flowrates avoiding sprayers to not overlap properly or for the spray to surge. The following settings for the transition from low to high flowrate were found empirically to give excellent results.

$S_{max,P}=5$
$S_{min,P}=1$
$S_{max,I}=4$
$S_{min,I}=0$

Criteria for ending transition was an elapsed time of 100 ms.

If $E_{rel}$ is 25% or 0.25, the scale factors have the following values.

$$SF_P=(5-1)*0.25+1=2.0$$

$$SF_I=(4-0)*0.25+0=1.0$$

If $E_{rel}$ is 10% or 0.1, the scale factors have the following values.

$$SF_P=(5-1)*0.1+1=1.4$$

$$SF_I=(4-0)*0.1+0=0.4$$

If $E_{rel}$ is 1% or 0.01, the scale factors have the following values.

$$SF_P=(5-1)*0.01+1=1.04$$

$$SF_I=(4-0)*0.01+0=0.04$$

If $E_{rel}$ is 0% or 0.00, the scale factors have the following values.

$$SF_P=(5-1)*0.00+1=1.00$$

$$SF_I=(4-0)*0.00+0=0.00$$

As can be seen, the gains vary based on the value of $E_{rel}$. For values of $E_{rel}$ below 0.25, the effect is to decrease the integral gain, $K_I$. For all values of $E_{rel}$ except zero, the proportional gain is increased. For all practical values of the relative error, $SF_P$ is higher than $SF_I$. This is because, pursuant to the inventors' insight, the integral term has less importance during the transition to low flowrate mode.

The following settings for the transition from low to high flowrate were found empirically to give excellent results.

$S_{max,P}=1$
$S_{min,P}=1$
$S_{max,I}=0$
$S_{min,I}=0$

Criteria for ending transition was an elapsed time of 500 ms.

If $E_{rel}$ is 25% or 0.25, the scale factors have the following values.

$$SF_P=(1-1)*0.25+1=1$$

$$SF_I=(0-0)*0.25+0=0.0$$

If $E_{rel}$ is 1% or 0.01, the scale factors have the following values.

$$SF_P=(1-1)*0.01+1=1$$

$$SF_I=(0-0)*0.01+0=0.0$$

As can be seen, $SF_P$ is always 1 and $SF_I$ is always 0 during the transition from high to low speed. This is because, pursuant to the inventors' insight, the integral term has less importance during transitions.

Relative error, $E_{rel}$ is defined as the absolute value of the error, i.e., actual value minus the target value, divided by the target value.

While the invention has been described with respect to certain embodiments, as will be appreciated by those skilled in the art, it is to be understood that the invention is capable of numerous changes, modifications and rearrangements, and such changes, modifications and rearrangements are intended to be covered by the following claims.

What is claimed is:

1. An asphalt distributor for spraying asphalt onto the ground at a variable flowrate, the asphalt distributor comprising:

a multispeed hydraulic motor having a first speed, a second speed, and an adjustable swashplate, the adjustable swashplate having a first position corresponding to the first speed and a second position corresponding to the second speed, an asphalt pump mechanically driven by the multispeed hydraulic motor, and a controller for controlling the flow rate of asphalt being sprayed, the controller having a gain for controlling the flow rate, a first mode in which the adjustable swashplate is in the first position, a second mode in which the adjustable swashplate is in the second position, and a transition mode for the movement of the adjustable swashplate between the first position and the second position, the first mode having a first flowrate range, the second mode having a second flowrate range different from the first flowrate range and overlapping at its lower end with the first flowrate range, the gain having a value for the first mode, a value for the second mode, and a value for the transition mode, the value for the transition mode being different from the value for the first speed and the value for the second speed, the controller entering into the transition mode when the motor switches between first speed and second speed.

2. The asphalt distributor of claim 1 further comprising an engine and a hydraulic pump driven by the engine wherein the controller changes the flow rate of hydraulic fluid pumped by the hydraulic pump for achieving a desired asphalt flow rate.

3. The asphalt distributor of claim 1 wherein the transition mode has a predetermined duration.

4. The asphalt distributor of claim 1 wherein the transition mode ends when an absolute relative error is calculated by the controller to below 5%, the absolute relative error being the absolute difference between the flow rate and a desired flow rate divided by the desired flow rate.

5. The asphalt distributor of claim 1 wherein the gain is selected from a proportional gain, an integral gain and a derivative gain.

6. The asphalt distributor of claim 1 wherein the value of the gain during the transition mode is dynamically adjusted.

7. The asphalt distributor of claim 6 wherein the dynamic adjustment of the gain comprises an increase in the proportional gain of the controller.

8. The asphalt distributor of claim 7 wherein the increase in the proportional gain is a function of an absolute relative error and the increase increases as the absolute relative error increases, the absolute relative error being the absolute difference between the flow rate and a desired flow rate divided by the desired flow rate.

9. The asphalt distributor of claim 6 wherein the dynamic adjustment of the gains comprises a decrease in an integral gain of the controller.

10. The asphalt distributor of claim 9 wherein the decrease in the integral gain is a function of an absolute relative error and the decrease increases as the absolute relative error decreases, the absolute relative error being the absolute difference between the flow rate and a desired flow rate divided by the desired flow rate.

11. The asphalt distributor of claim 1 wherein the controller is a PI or PID controller having a proportional gain and an integral gain, the value of the proportional gain for the transition mode being the same as a proportional gain for the second mode and the value of the integral gain for the transition mode being zero when the transition mode is for a switch from the first speed to the second speed.

12. The asphalt distributor of claim 1 wherein the controller is a P, PI or PID controller having a proportional gain, the controller dynamically adjusting the proportional gain in transition mode, the adjusted proportional gain being the mathematical product of a base proportional gain and an adjusting function for the proportional gain, the adjusting function for the proportional gain being a linear function of the absolute relative error, and the adjusting function for the proportional gain having a value of 1 when the absolute relative error is zero.

13. The asphalt distributor of claim 12 wherein the base proportional gain is the proportional gain for the mode corresponding to the speed that was switched to.

14. The asphalt distributor of claim 13 wherein the controller is a PI or PID controller having an integral gain, the controller dynamically adjusting the integral gain in transition mode, wherein the adjusted integral gain is the mathematical product of a base integral gain and an adjusting function for the integral gain, the adjusting function for the integral gain being a linear function of the absolute relative error, and the adjusting function for the integral gain having a value of 0 when the absolute relative error is zero.

15. The asphalt distributor of claim 14 wherein the base integral gain is the integral gain for the mode corresponding to the speed that was switched to.

16. A method of controlling the flow rate of an asphalt pump driven by a multispeed hydraulic motor during a transition for a speed change of the motor, the method comprising:

changing the speed of the hydraulic motor by adjusting a swashplate in the hydraulic motor, and during the transition for the speed change, dynamically adjusting a proportional gain and an integral gain of a PI or PID controller controlling the flow rate during the transition as a function of the absolute relative error, the absolute relative error being the absolute difference between the flow rate and a desired flow rate divided by the desired flow rate, the adjustment of the proportional gain being different from adjustment of the integral gain.

17. The method of claim 16 wherein the adjusted proportional gain is the mathematical product of a base proportional gain and an adjusting function for the proportional gain, the adjusting function for the proportional gain being a linear function of the absolute relative error, and the adjusting function for the proportional gain has a value of 1 when the absolute relative error is zero.

18. The method of claim 17 wherein the base proportional gain is the proportional gain for the speed that the speed was changed to.

19. The method of claim 16 wherein the adjusted integral gain is the mathematical product of a base integral gain and an adjusting function for the integral gain, the adjusting function for the integral gain being a linear function of the absolute relative error, and the adjusting function for the integral gain has a value of 1 when the absolute relative error is zero.

20. The method of claim 19 wherein the base integral gain is the integral gain for the speed that the speed was changed to.

* * * * *